US006012214A

United States Patent [19]

Kutschker et al.

[11] Patent Number: 6,012,214

[45] Date of Patent: Jan. 11, 2000

[54] FOLDING MACHINE

[75] Inventors: Wolfgang Kutschker, Boeblingen; Erwin Pesold, Sindelfingen; Adolf Mayer, Magstadt; Wolfhart Rodestock, Magstadt, all of Germany

[73] Assignee: Reinhardt Maschinenbau GmbH, Sindelfingen, Germany

[21] Appl. No.: 08/841,424

[22] Filed: Apr. 22, 1997

Related U.S. Application Data

[63] Continuation of application No. PCT/EP96/02941, Jul. 4, 1996.

[30] Foreign Application Priority Data

Aug. 23, 1995 [DE] Germany ..... 195 30 923

[51] Int. Cl.[7] ..... B21D 39/00

[52] U.S. Cl. ..... 29/505; 29/509; 29/715; 29/243.5; 72/210

[58] Field of Search ..... 29/714, 715, 505, 29/509, 514, 243.5, 243.58; 72/210, 211

[56] References Cited

U.S. PATENT DOCUMENTS

| | | | |
|---|---|---|---|
| 3,407,640 | 10/1968 | Lipp | 72/181 |
| 3,602,032 | 8/1971 | Skintzis . | |
| 3,636,903 | 1/1972 | Anderson et al. | 72/181 |
| 3,722,443 | 3/1973 | Anderson et al. | 113/54 |
| 5,184,384 | 2/1993 | Lipp | 29/243.5 |
| 5,353,616 | 10/1994 | Fischer et al. | 29/243.5 |
| 5,735,162 | 4/1998 | Mattsson et al. | 29/243.58 |

FOREIGN PATENT DOCUMENTS

| | | | |
|---|---|---|---|
| 1 452 750 | 4/1969 | Germany . | |
| 34 04 057 | 8/1985 | Germany . | |
| 4127481-A1 | 2/1993 | Germany | 72/210 |
| WO 90/14180 | 11/1990 | WIPO . | |

*Primary Examiner*—David P. Bryant
*Assistant Examiner*—Jermie E. Cozart
*Attorney, Agent, or Firm*—Barry R. Lipsitz; Ralph F. Hoppin

[57] ABSTRACT

In order to improve a folding machine for joining the edges of two sheet-metal parts forming an angle between them by means of a folding procedure, comprising a machine frame, a folding carriage movable on the machine frame by a drive in a guide means extending along a folding direction, this carriage having at least one pair of folding rollers for folding the edges of the sheet-metal parts, and holding devices arranged on the machine frame for fixing the sheet-metal parts in position during the folding procedure, such that large, in particular, long sheet-metal parts can be handled in a simple manner on this machine and are easy to insert into it, it is suggested that the guide means be movable in an essentially vertical direction, and that the folding machine have support surfaces arranged on a supporting plane extending at right angles to the folding direction, the sheet-metal parts being placeable on these support surfaces with edges which extend transversely to the edges resulting in the fold.

27 Claims, 6 Drawing Sheets

FOLDING MACHINE

This application is a continuation of International PCT Application No. PCT/EP96/02941 filed on Jul. 4, 1996.

The invention relates to a folding machine for joining the edges of two sheet-metal parts forming an angle between them by means of a folding procedure comprising a machine frame, a folding carriage movable on the machine frame by a drive in a guide means extending along a folding direction, this carriage having at least one pair of folding rollers for folding the edges of the sheet-metal parts, and holding devices arranged on the machine frame for fixing the sheet-metal parts in position during the folding procedure.

Folding machines of this type are known, for example, from European patent No. 0 472 530.

In the case of these known folding machines, the folding direction and thus the guide means for the movable folding carriage always runs in a horizontal direction so that the edges of the sheet-metal parts which are to be folded can also be positioned in planes, the intersecting line of which likewise extends essentially in a horizontal direction. In this respect, the planes are preferably arranged in a V shape relative to one another.

A folding machine of this type has the great disadvantage that the insertion of the sheet-metal parts, particularly large sheet-metal parts, causes difficulties since these sheet-metal parts likewise have to be inserted with edges extending approximately horizontally and thus difficulties already occur in the case of long sheet-metal parts on account of them bending over their length. In addition, at least two people are required for handling sheet-metal parts of this type having a horizontal alignment.

Finally, it is also necessary to support the inserted sheet-metal parts in a folding direction and, in particular, transversely to the folding direction, as well, over a large surface area in order to prevent any bending and, for example, any permanent deformation connected thereto and thus an unsatisfactory positioning for the folding procedure.

The object underlying the invention is therefore to improve a folding machine of the generic type such that large, in particular, long sheet-metal parts can be handled in a simple manner on this machine and are easy to insert into it.

This object is accomplished in accordance with the invention, in a folding machine of the type described at the outset, in that the guide means extends in an essentially vertical direction such that the folding carriage guided on it is movable in an essentially vertical direction during the folding procedure, and that the folding machine has support surfaces arranged on a supporting plane extending at right angles to the folding direction, the sheet-metal parts being placeable on these surfaces with edges which extend transversely to the edges resulting in the fold.

The inventive solution has the big advantage that a completely new type of handling of large, in particular, long sheet-metal parts results due to the vertical course of the guide means and of the folding direction. These long sheet-metal parts can, on the one hand, be handled in a vertical alignment during insertion into the folding machine so that this is possible by a single operator and, on the other hand, there is also no necessity, due to the positioning of the long sheet-metal parts in a vertical direction, of supporting these in folding direction and transversely to the folding direction. Rather, a fixing in position of the sheet-metal parts at their ends, i.e. in this case an upper and, where necessary, lower fixing in position, is already sufficient since these do not have any tendency to sag or bend on account of their vertical alignment.

An additional, particular advantage of the inventive solution is, furthermore, to be seen in the fact that due to the support surfaces extending in the supporting plane at right angles to the folding direction advantages likewise result, in addition, during handling due to the fact that the sheet-metal parts can be placed or set up on these support surfaces prior to and/or following the insertion into the folding machine.

A particularly advantageous solution provides, in this respect, for the sheet-metal parts to be prealignable by the support surfaces for their fixing in position by means of the holding devices. This means that the placement of the sheet-metal parts on the support surfaces already serves as a prealignment thereof for the fixing in position by means of the holding devices and is thus, also, a considerable alleviation during the alignment of the sheet-metal parts during their insertion.

A particularly advantageous embodiment provides for the sheet-metal parts to be positionable exactly by means of the support surfaces relative to the machine frame for the fixing in position by means of the holding devices, i.e. the sheet-metal parts preferably remain standing on the support surfaces during their fixing in position and thus obtain their exact alignment during the fixing in position due to the support surfaces and, moreover, are additionally supported by the support surfaces in the fixed state in order to ensure a reliable and displacement-free fixing of the sheet-metal parts during the folding procedure.

The support surfaces could be designed in the most varied of ways. It would, for example, be possible to arrange the support surfaces as strip-like areas close to the locations of the sheet-metal parts when in the state inserted in the folding machine.

A particularly simple handling of the sheet-metal parts is attained when the support surfaces are part of a table surface extending at right angles to the folding direction so that a large table area is available for placing the sheet-metal parts on them, on the one hand, already prior to and/or following the insertion, i.e. during handling by the operator, and, where necessary, for inserting them into the folding machine by sliding along the table surface.

A particularly expedient solution for the folding machine, in particular during advantageous handling of the sheet-metal parts during insertion, provides for the guide means to extend downwards beyond at least one length of the folding carriage on a side of the supporting plane located opposite one of the holding devices. This solution creates the possibility of positioning the folding carriage either in a starting position prior to the folding procedure or in an end position following the folding procedure such that the folding procedure can begin at the level of the supporting plane or end at the level of the supporting plane, i.e. the sheet-metal parts can be set up directly at the level of the supporting plane.

Furthermore, it is advantageous when the folding carriage can be positioned in a starting position for the folding procedure on the side of the supporting plane located opposite the holding devices so that the folding procedure always begins at the level of the supporting plane. This has the advantage that the folding carriage can be positioned in the starting position at a slight distance beneath the supporting plane and thus the folding procedure always begins without any great forward movement independently of the extension of the sheet-metal parts in vertical direction whereas, when a starting position is provided in an upper end region of the guide means, different lead times would be necessary for the beginning of the folding procedure in the case of sheet-metal parts of different heights when the sheet-metal parts having different heights are always positioned to begin at the level of the supporting plane.

With respect to the design of the holding devices, no details have yet been given. One advantageous embodiment provides, for example, for each holding device to have a contact surface, against which the respective sheet-metal part can abut, wherein the contact surface serves to position the sheet-metal part exactly relative to the machine frame.

In addition, it is advantageously provided for each holding device to be designed as a clamping device and to have as contact surface a first clamping surface, against which the sheet-metal part can abut.

In addition, it is preferably provided for each clamping device to have at least one clamping element with a second clamping surface which can be moved relative to the first clamping surface for clamping the sheet-metal parts.

In principle, it would be possible to design the clamping devices such that they clamp the sheet-metal part at edges which extend parallel to the edges resulting in the fold. This does, however, have the great disadvantage that the clamping cannot extend as close as possible to the edge resulting in the fold. For this reason, it is preferably provided for each clamping device to clamp an edge region of the sheet-metal part extending transversely to the folding direction.

With respect to the number and arrangement of the holding devices, no further details have been given. In principle, it would be possible to fix the sheet-metal part in position only at its edge regions located closest to the folding carriage in its starting position. In this respect, there would, however, be the risk of the sheet-metal part not being adequately fixed in position during its folding procedure.

For this reason, the preceding solution provides for the sheet-metal part to be fixed in position by means of a holding device at both edge regions located opposite one another in folding direction.

One holding device is, therefore, preferably provided which is able to fix in position an edge region of the sheet-metal parts level with the supporting plane.

Since, within the scope of the inventive solution, the supporting plane advantageously serves for the placement of the respective edge region on it in order to preposition this at least for the fixing in position, it is advantageously provided for the holding device arranged at the level of the supporting plane to be arranged stationary on the machine frame.

Furthermore, a holding device arranged at a distance from the supporting plane is preferably provided for each sheet-metal part.

In order to be able to fix in position sheet-metal parts having different lengths, i.e. extending to different heights above the support surface, it is preferably provided for the holding device arranged at a distance from the supporting plane to be displaceable in folding direction, i.e. preferably in an essentially vertical direction.

For this purpose, a guide means arranged on the machine frame and extending essentially in a vertical direction is preferably provided for the holding device, in which this can be positioned at different distances from the supporting plane.

In order to ensure a simple insertion of the sheet-metal parts with defined lengths, it is preferably provided for the holding device to be secured in position in the respective guide means at predeterminable distances from the supporting plane.

In the simplest case, this can be achieved by means of a fixing element engaging in the guide means, the holding device displaceable in the guide means being supported on this element.

During insertion of the sheet-metal parts into an inventive folding machine, it is not only necessary to ensure a reliable fixing in position of the inserted sheet-metal parts. It is necessary, in addition, to position the sheet-metal parts with the edges resulting in the fold exactly in a folding region, through which the folding carriage passes.

For this reason, pivotable stops are preferably provided on the machine frame for a positioning of the edges of the sheet-metal parts resulting in the fold.

In principle, it would be possible to provide a separate stop for the edge of each of the sheet-metal parts resulting in the fold. However, a particularly advantageous inventive solution provides for one stop to be provided for the edges of both sheet-metal parts resulting in the fold.

The stop preferably comprises two receiving means designed in an approximately V shape for the edges of the sheet-metal parts resulting in the fold.

Since, in the case of long sheet-metal parts, i.e. high in a vertical alignment, an operator generally requires both hands to handle these parts, a particularly advantageous embodiment provides for the stops to be provided with edge sensors for each sheet-metal part which detect whether the respective sheet-metal part is resting against the stop, preferably in the receiving means thereof. Therefore, the great advantage is already achieved that a signal can be generated by means of an edge sensor of this type which signalizes to an operator that the sheet-metal part is inserted into the folding machine in the required position.

A particularly expedient, further development of this solution provides for the edge sensor to be connected to a control which activates at least one holding device for the respective sheet-metal part when the edge sensor is triggered. This solution has the great advantage that the operator merely needs to insert the sheet-metal part into the folding machine and then, when the stop is contacted, the edge sensor automatically activates at least one holding device in order to secure the sheet-metal part so that the operator can ascertain as a result of the activation of the holding device that the sheet-metal part is positioned but, on the other hand, the activated holding device then already secures the sheet-metal part in this position.

In this respect, it is particularly advantageous when the control activates the holding device arranged at a distance above the support surfaces since the sheet-metal part "hangs" on this holding device arranged at a distance from the supporting plane and thus any risk of a sheet-metal part of this type falling over can be avoided. In this respect, it is possible to activate the holding device arranged at the level of the supporting plane by means of a further activation on the part of the operator. It is, however, particularly advantageous when the holding device arranged at the level of the supporting plane is also activated via the control.

Furthermore, the invention relates to a process for joining sheet-metal parts by means of a folded seam connection integrally formed at their edges, wherein the sheet-metal parts are inserted into a folding machine, are fixed in position on this and the folded seam connection is produced by a folding carriage moving in a folding direction along the facing edges of the sheet-metal parts, wherein, in accordance with the invention, the sheet-metal parts are inserted into the folding machine and fixed in position with an essentially vertical alignment of the edges resulting in the folded seam connection and the folding carriage is then moved in an essentially vertical direction.

This inventive process has the same advantages as the inventive solution described in the above.

In the case of this process it is particularly advantageous when the sheet-metal parts are supported prior to and/or during the insertion on support surfaces which are located in a supporting plane extending at right angles to the folding direction since such a handling offers the possibility of being able to handle, in particular, large sheet-metal parts, i.e. those extending in vertical direction over a great height, with one single operator.

In this respect, it is particularly expedient when the sheet-metal parts are placed on a table surface extending in the supporting plane prior to production of the folded seam connection or after production of the folded seam connection in order to likewise facilitate their handling.

A particularly advantageous solution of the inventive process provides, in this respect, for sheet-metal parts angled at least once to be used as sheet-metal parts, these having a border extending approximately parallel to the edge resulting in the fold. Sheet-metal parts of this type may be handled particularly advantageously with the inventive process since they may be placed on the support surfaces with their edges extending transversely to the edges resulting in the folded seam connection and thus also with edges extending transversely to the border resulting due to the angle and, on account of their angle, have an adequate inherent rigidity to allow them to be inserted into the inventive folding machine in a simple manner.

However, the inventive process is also suitable for joining parts consisting of sheet metal with one another that are angled not only once but several times, wherein, in the extreme case, the two sheet-metal parts to be joined to one another in accordance with the inventive process are elements of a single, coherent part consisting of sheet metal.

The inventive process serves, in particular, to produce sheet-metal channels, preferably for ventilation technology.

Additional features and advantages of the invention are the subject matter of the following description as well as the drawings of several embodiments.

Figure 1:
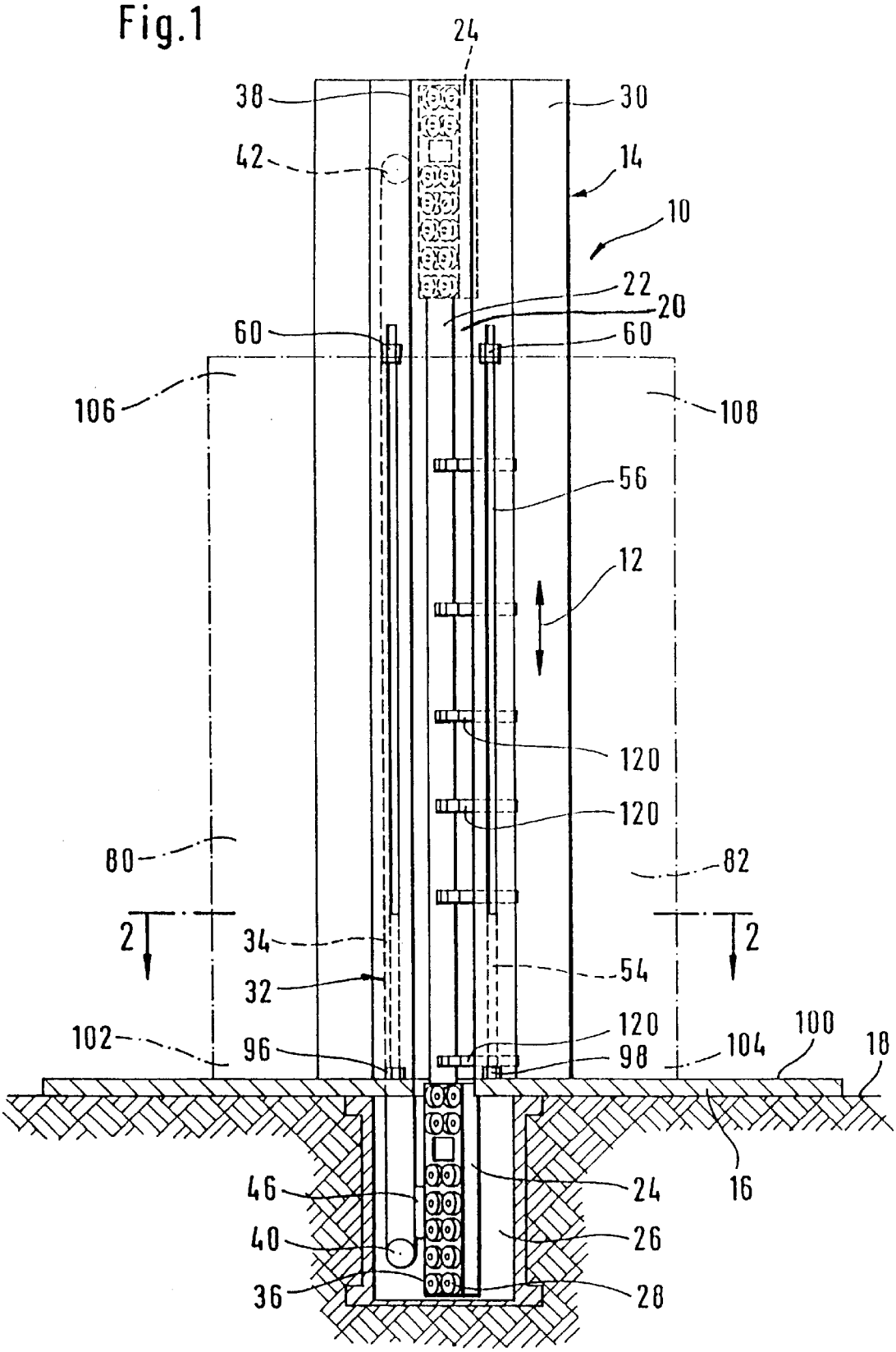
FIG. 1 shows a partial, vertically cutaway side view of a first embodiment of an inventive folding machine.

A first embodiment of an inventive folding machine, illustrated in FIG. 1, comprises a machine frame which is designated as a whole as 10 and has a column 14 extending in vertical direction 12 and rising above a table 16 of the machine frame 10.

In this respect, the table 16 and the column 14 are, in the case of the first embodiment illustrated in FIG. 1, anchored to a floor 18.

Figure 2:
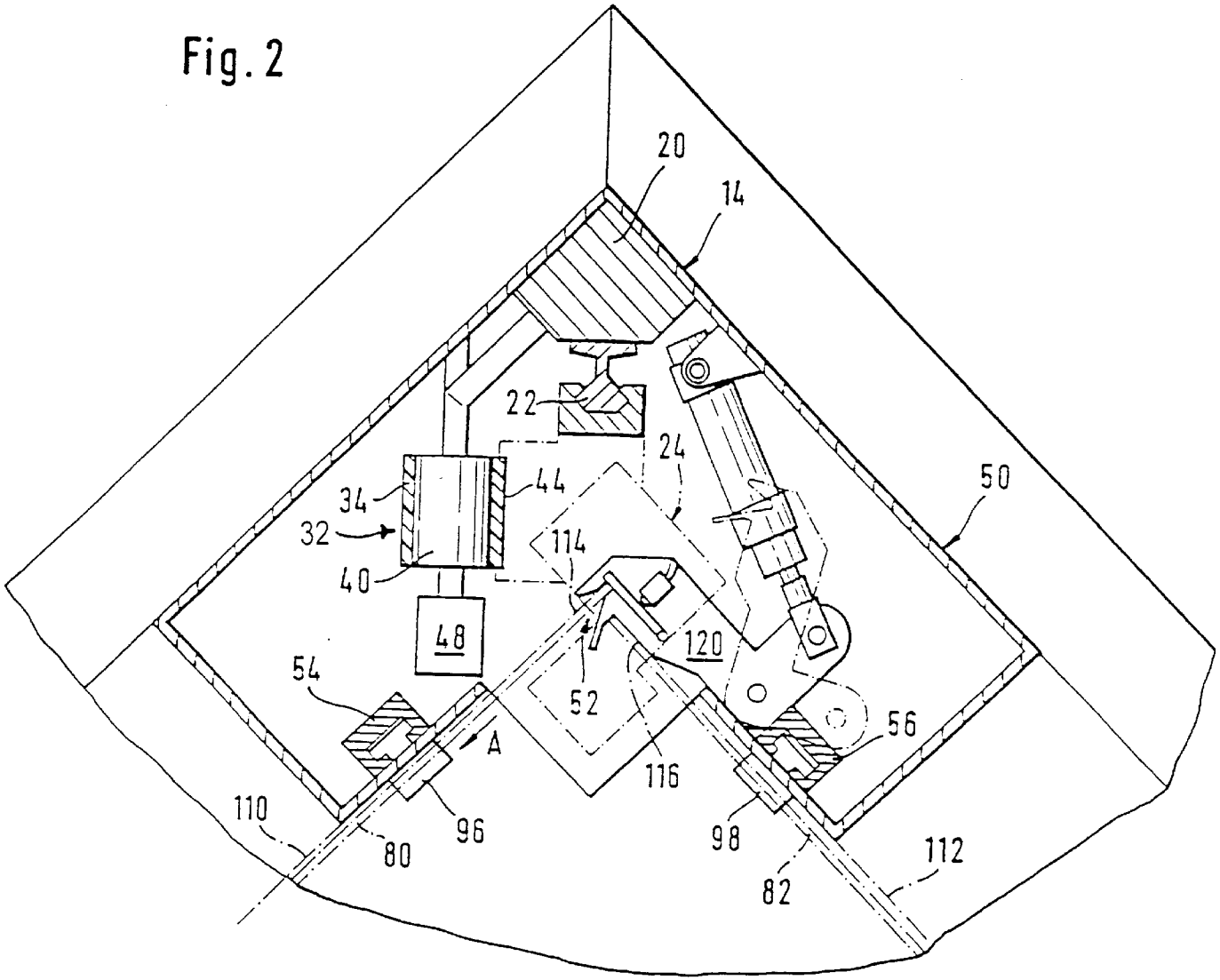
FIG. 2 shows a section along line 2—2 in FIG. 1.

As illustrated in FIG. 2, the column 14 comprises a column stand 20 which likewise extends in the vertical direction 12 and on which a guide rail 22 for a folding carriage designated as a whole as 24 is held.

The column stand 20 as well as the guide rail 22 extend, as illustrated in FIG. 1, in vertical direction beyond the table 16 downwards into a recess 26 of the floor, namely to such an extent that the folding carriage 24 can be positioned in the recess 26 beneath the table 16.

The folding carriage 24 is designed in a known manner, such as that described, for example, in European patent No. 0 472 530, and comprises a plurality of pairs 28 of folding rollers for joining the edges of two sheet-metal parts extending at an angle to one another, as will be described in detail in the following. Furthermore, the design and function of pairs of folding rollers of this type is known from German patent No. 1 452 7$50.

The folding carriage 24 is, as illustrated, in addition, in FIG. 1, movable along the guide means 22 over the entire length of the column 14, and preferably from a lower starting position, in which it is located in the recess 26, into an upper end position, illustrated by dashed lines in FIG. 1, in an upper end region 30 of the column 14. A belt drive 32 is provided for moving the folding carriage 24 from the starting position into the end position and back, as illustrated in FIGS. 1 and 2. This belt drive comprises an endless pulling strap 34 which is guided near to a lower end 36 of the guide rail 22 and near to an upper end 38 of the guide rail 22 over a respective deflecting roller 40 or 42 and can be driven by a motor 48 which drives, for example, the lower deflecting roller 40. For moving the folding carriage 24, this is connected with a strand 44 of the pulling strap 34.

The column 14 has, in addition, a column housing which is designated as a whole as 50 and in which the column stand 20 with the guide rail 22 and also the entire belt drive 32 as well as part of the folding carriage 24 are arranged.

Figure 3:
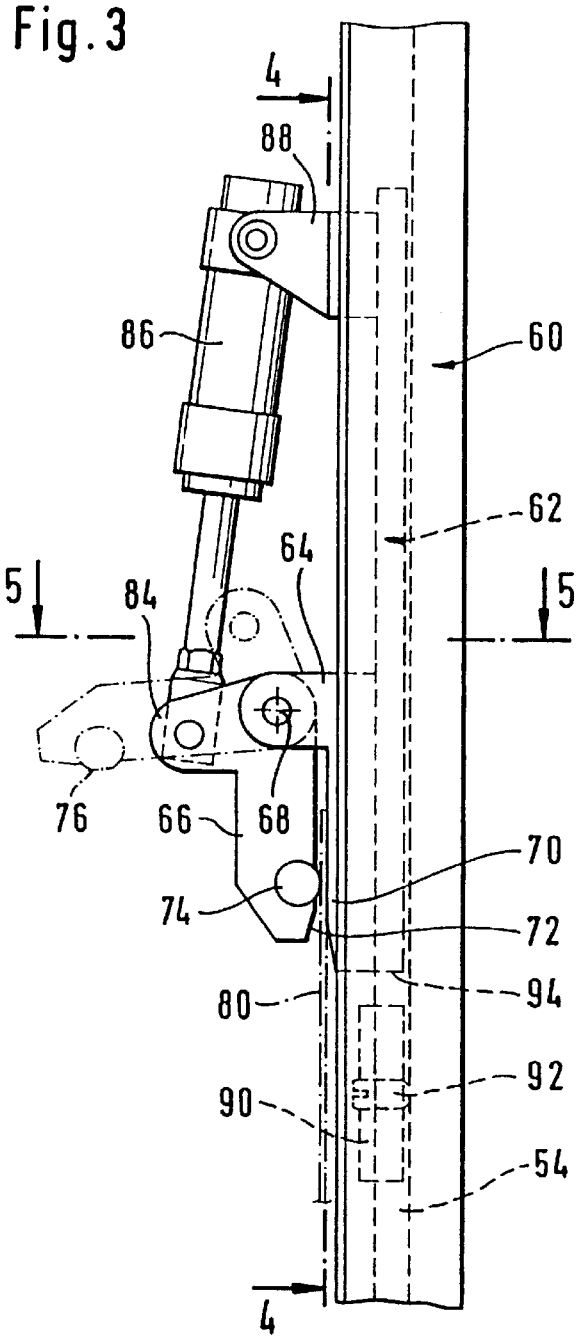
FIG. 3 shows a side view of a clamping device in the direction of arrow A in FIG. 2.
Figure 4:
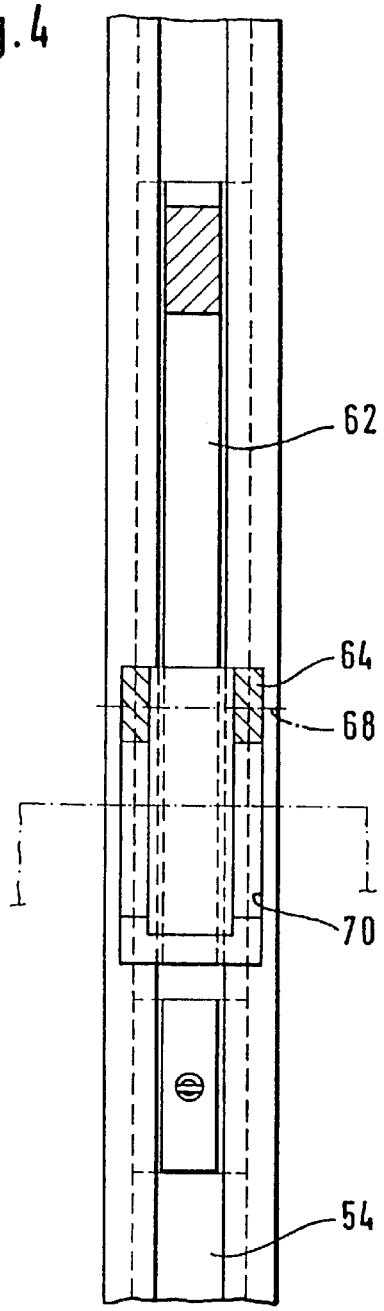
FIG. 4 shows a section along line 4—4 in FIG. 3.
Figure 5:
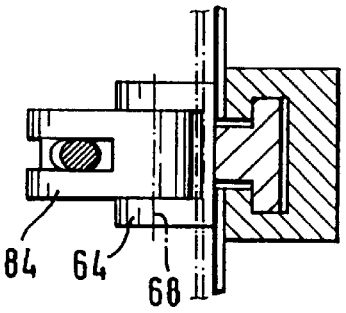
FIG. 5 shows a section along line 5—5 in FIG. 3.

This column housing 50 comprises, in addition and as illustrated in FIG. 2, two vertical guide means 54, 56 arranged at a distance from a folding region 52, in which the folding carriage 24 can be displaced with its pairs 28 of folding rollers in a vertical direction 12. These vertical guide means are designed, for example, as T-shaped grooves and clamping devices 60 are arranged in them, as illustrated in FIG. 3, FIG. 4 and FIG. 5, so as to be displaceable as holding devices in vertical direction 12.

Each of these clamping devices 60 comprises a guide bar 62 guided i n the respective vertical guide means 54 or 56 and bearing flanges 64, which are located above the respective vertical guide means 54 or 56 and in which a clamping arm 66 is mounted so as to be pivotable about an axis 68 extending transversely to the longitudinal direction of the respective vertical guide means 54 or 56, are held on the guide bar.

In addition, a clamping jaw 70 which is rigidly connected to the guide bar 62 is held on this guide bar and bears a clamping surface 72.

The clamping arm 66 comprises, for its part, a clamping arm jaw 74 so that a sheet-metal part 80 can be clamped, for example, between this clamping arm jaw 74 with a clamping surface 76 and the clamping surface 72.

For the actuation of the clamping arm 66, a clamping cylinder 86 engages on an actuating arm 84 extending at an angle to this clamping arm. The clamping cylinder is articulatedly connected to the actuating arm 84 with, for example, a piston rod and articulatedly connected with a cylinder housing to a cylinder mounting 88 which is, for its part, again seated rigidly on the guide bar 62.

A clamping device 60 of this type is mounted in each of the vertical guide means 54 and 56 so as to be displaceable in vertical direction 12 and adjustable in its height above the table 16, wherein an adjustment of the height of the respective clamping device 60 is possible by way of a groove block 90 which can be secured in position in the respective vertical guide means 54, 56 and be fixed in position in the respective vertical guide means 54, 56 via, for example, a tightening screw 92. The clamping device 60 is thereby supported by a lower end face 94 of the guide bar 62 and is thus secured against any downward sliding along the respective vertical guide means 54, 56 in the direction of the table 16.

Moreover, a clamping device 96 or 98 operative at the level of the table 16 is provided to be aligned with each of the vertical guide means 54, 56 in vertical direction 12 and is fixed in position on the column housing 50 so as to be non-displaceable.

The clamping device 96 serves to clamp the sheet-metal part, which is supported on a table surface 100 as support surface with its lower edge 102, in the region of this lower edge 102 and the clamping device 98 is in a position to also clamp the sheet-metal part 82, which is supported on the table surface 100 as support surface with its lower edge 104, in the region of this lower edge 104.

In this respect, the clamping devices 96 and 98 are of an identical design to the displaceable clamping devices 60, with the exception of the displaceable guide bar 62, and function in an identical manner.

The clamping device 60 arranged in the vertical guide means 54 serves, for its part,—as already mentioned—to clamp the sheet-metal part 80 in the region of its upper edge 106 and the clamping device 60 arranged in the vertical guide means 56 serves to clamp the sheet-metal part 82 in the region of its upper edge 108, wherein the height alignment of the displaceable clamping devices 60 in the vertical guide means 54 and 56 takes place by means of the groove blocks 90 prior to abutment of the sheet-metal parts 80, 82.

The clamping device 60 arranged in the vertical guide means 54 and the clamping device 96 are aligned such that their stationary clamping surfaces 72 are located in a common plane 110 so that they hold the clamped sheet-metal part 80, for example a sheet-metal plate, so as to be likewise aligned parallel to this plane 110.

Furthermore, the clamping device 60 arranged in the vertical guide means 56 and the clamping device 98 are aligned such that their stationary clamping surfaces 72 are likewise located in a common plane 112, wherein the plane 112 extends at an angle transversely to the plane 110, preferably at right angles to the plane 110. This means that the sheet-metal part 82, for example likewise a sheet-metal plate, can be aligned parallel to the plane 112 and thus transversely to the sheet-metal part 80 in the clamped state by means of the clamping device 60 in the vertical guide means 56 and the clamping device 98.

For the defined alignment of a vertical edge 114 of the sheet-metal part 80 and of a vertical edge 116 of the sheet-metal part 82 in the folding region 52, a plurality of stops 120 which are arranged one above the other in vertical direction 12 and pivotable out of the folding region 52 are provided on the column housing 50. Each of these pivotable stops 120 comprises, as illustrated in detail in FIG. 6, a stop arm 124 which is pivotable about a pivot axis 122 and has a stop surface 128 for the vertical edge 114 of the sheet-metal part 80 in its end region 126 facing away from the pivot axis 122. The stop surface 128 is thereby located on the floor side of a V-shaped receiving means 130 for the vertical edge 114, which is aligned in the stop position of the pivot arm 124 illustrated by solid lines in FIG. 6 such that its central axis extends parallel to the plane 110 so that the V-shaped receiving means 130 opens in the direction of the vertical guide means 54. Thus, the vertical edge 114 of the sheet-metal part 80 can, during displacement in the direction of the V-shaped receiving means 130 and with an approximately parallel alignment to the plane 110, be pushed into the V-shaped receiving means 130 to such an extent until a vertical border 132 of the vertical edge 140 abuts on the stop surface 128.

In order to detect when the vertical border 132 has come to rest directly on the stop surface 128 during insertion, a sensor finger 134 is articulated to the pivot arm 124 so as to be pivotable about a likewise vertical axis 136. Its position is detected by a contact key 138, in the simplest case a push-button key. The contact key 138 and the sensor finger 134 are arranged such that the sensor finger with its sensor surface 140 is located in front of the stop surface 128 in the initial state of the contact key 138 and when the sensor surface is moved in the direction of the stop surface 128 by the vertical border 132 which comes to rest on the stop surface 128, the contact key 138 is in its switching position, in which the contact key 138 indicates to a control 142 that the vertical border 132 has reached the stop surface 128. The control 142 is designed such that, in this case, it activates the clamping device 60 in the vertical guide means 54, like the clamping device 96, in such a manner that the respective clamping arms 66 are transferred from their open position into the clamping position and clamp the sheet-metal part 80 firmly between the clamping surfaces 76 and 72.

This creates the possibility of a single operator being able to grip the sheet-metal part 80 with both hands during insertion into the inventive folding machine and, for example, with the lower edge 102 sliding on the table surface 100, aligned at an acute angle to the plane 110 or approximately parallel to it, to insert the sheet-metal part into the V-shaped receiving means 130 with the vertical edge 114, when the pivot arms 124 are in a stop position, to such an extent until the vertical border 132 abuts on the stop surface 128. This is indicated to the control 142 by the sensor finger 134 interacting with the contact key 138 and the control then actuates the clamping devices 60 and 96 and automatically clamps the sheet-metal part 80 so that this can be positioned, on the one hand, as predetermined by the stop surface 128 and, on the other hand, can be automatically clamped. This creates the possibility of inserting large sheet-metal parts 80 which are difficult to handle into the inventive folding machine by means of a single person and clamping them in an exact position for the folding procedure. Moreover, a stop surface 148 is also provided on the pivot arm 24 for a vertical border 150 of the vertical edge 116 of the sheet-metal part 82 which is likewise arranged in a receiving means 152 opening towards the vertical guide means 56, wherein the receiving means 152 is arranged such that the vertical border 150 extends at a slight distance in relation to the plane 110.

A sensor finger which is not illustrated in the drawing with a contact key which is likewise not illustrated in the drawing are also associated with the stop surface 148 and these elements are likewise in a position to indicate to the control 142 when the vertical border 150 of the vertical edge 116 has reached the stop surface 148.

The function is identical to that described in conjunction with the sheet-metal part 80 and so the sheet-metal part 82 can likewise be positioned in the same manner by a single person in a defined position with the vertical edge 116 in the folding region 52, wherein for this purpose the respective pivot arm 124 is also in a stop position.

Each of the pivot arms 124 is provided with an actuating arm 156, to which a pivot drive 158, for example likewise in the form of a cylinder, is articulately connected, for example with a piston rod, whereas a cylinder housing of the pivot drive 158 is pivotally held in a bearing 160 which is rigidly connected to the column housing 50.

Figure 6:
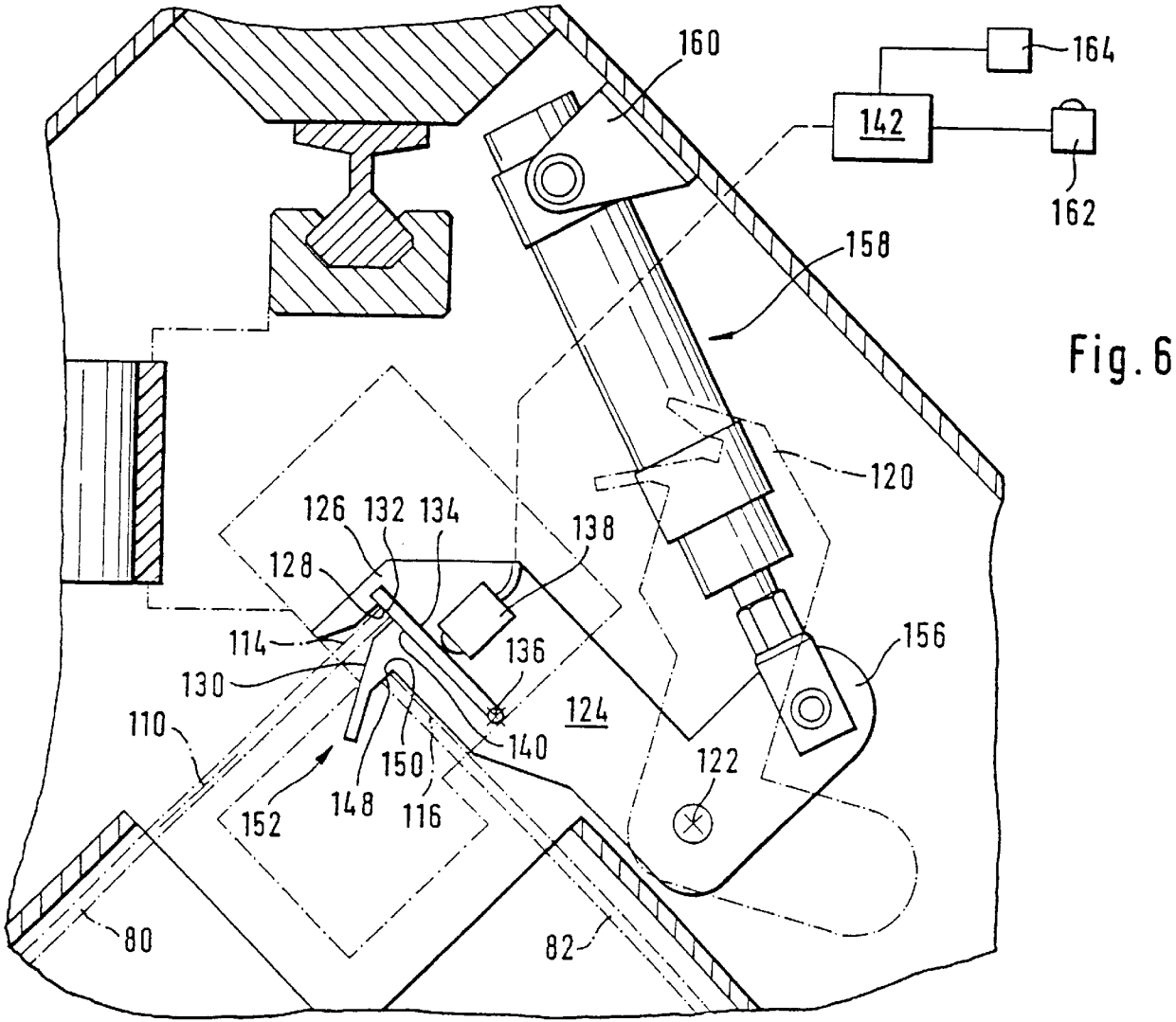
FIG. 6 shows an enlarged, sectional illustration of a folding region in FIG. 2.
Figure 7:
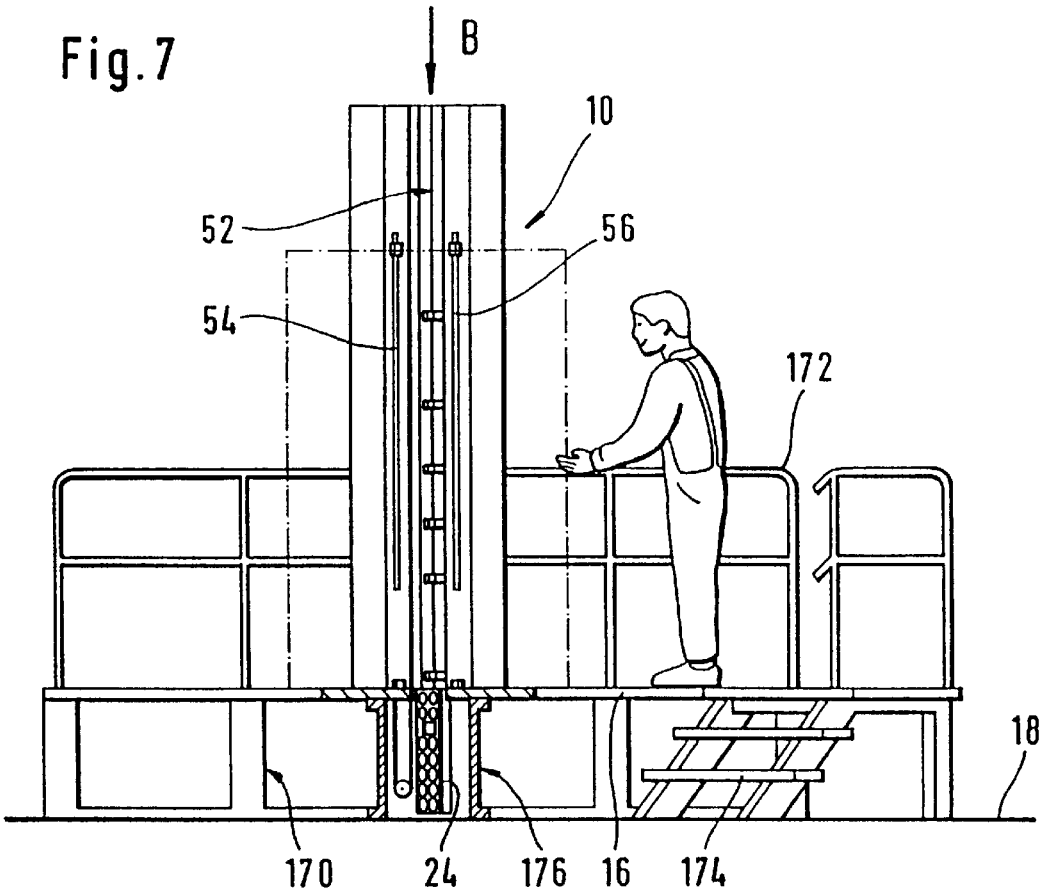
FIG. 7 shows a partial, vertically cutaway side view of a second embodiment of an inventive folding machine.
Figure 8:
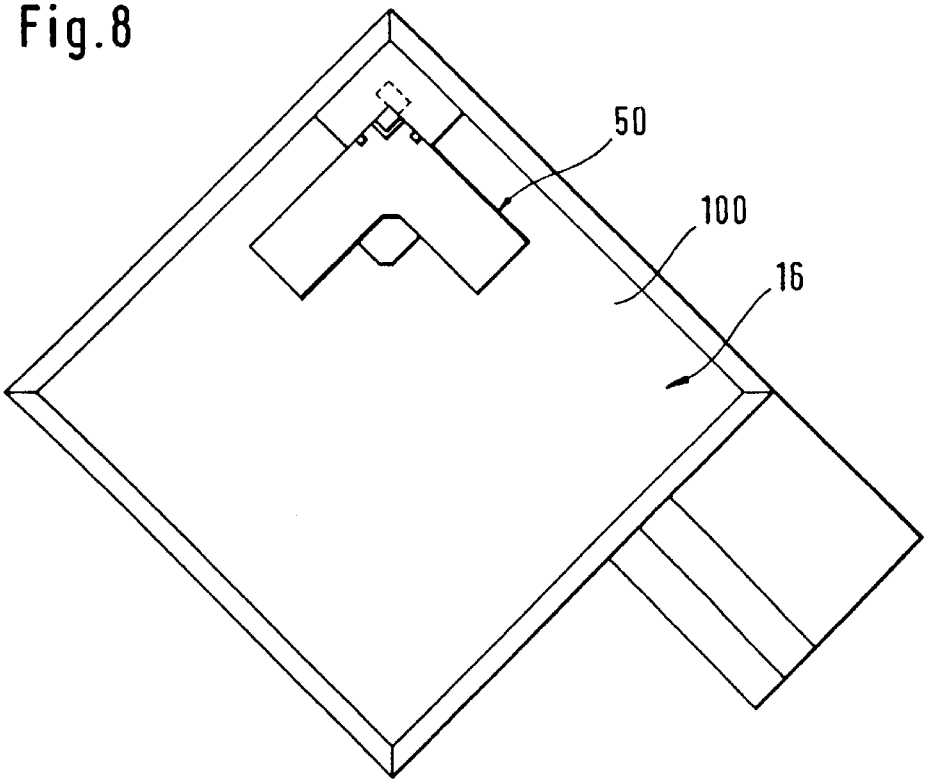
FIG. 8 shows a plan view in the direction of arrow B in FIG. 7.

The pivot drives 158 can also be actuated by means of the control 142, wherein this sees to it that the respective pivot arms 124 are each pivoted out of the folding region 52 into an inactive position—illustrated in FIG. 6 by dash-dot lines—when the folding carriage 24 passes through the folding region 52, wherein the inactive position is selected such that the folding carriage 24 can pass the pivot arms 124 without colliding with them.

The inventive folding machine preferably operates in such a manner that the folding carriage 24 is first of all located in its starting position, i.e. in the recess 26. In this position, the control 142 pivots all the pivot arms 124 of the pivot stops 120 into the stop position illustrated in FIG. 6 by solid lines.

An operator now positions the sheet-metal parts 80 and 82 one after the other in the manner already described, wherein the sheet-metal parts 80 and 82 are automatically clamped in the position of the vertical borders 132 and 150 required for producing a folded seam connection by means of the clamping device 60 in the vertical guide means 54, the clamping device 96, the clamping device 60 in the vertical guide means 56 and the clamping device 98 and are thus held in the desired position.

Subsequently, the operator actuates a switch 162, for example a foot-operated switch, connected to the control 142, whereupon the control 142 starts the folding procedure, which means that the belt drive 32 driven by the motor 48 moves the folding carriage 24 from the starting position into the end position and the control 142 sees to it at the same time that prior to the folding carriage 24 arriving in the respective section of the folding region 52 the pivot arm 124 located in this section is pivoted by means of the pivot drive 158 from the stop position into the inactive position in order to allow the folding carriage 24 to pass without colliding.

After completion of the folded seam connection between the sheet-metal parts 80 and 82, the operator actuates an additional switch 164, whereupon the control 142 releases the clamping of the sheet-metal parts 80 and 82 by means of the clamping devices 60 as well as 96 and 98 so that the operator can remove the sheet-metal parts 80 and 82 connected to one another or rotate them on the table surface 100 in order to carry out an additional folded seam connection.

Prior to a renewed folded seam connection being produced, the folding carriage 24 is returned from the end position into the starting position by actuation of the switch 162 in order to carry out a renewed folded seam connection, exactly as already described in the above.

Alternatively thereto, it is, however, also conceivable to select the position of the folding carriage 24 in the upper end region of the column 14 as starting position for the folding procedure so that, during the folding procedure, the original starting position in the recess 26 then represents the end position.

A second embodiment of an inventive folding machine operates, in principle, in an identical manner to the first embodiment and so reference is made in full to the first embodiment with respect to the individual components.

In contrast to the first embodiment, the table 16 is not, in the case of the second embodiment, placed on the floor 18 but arranged at a distance above the floor 18 by means of an underframe 170 and so the table 16 represents a platform which is raised above the floor 18, is provided for safety reasons with an outer boundary 172 and is accessible via steps 174.

This creates the possibility of providing a receiving housing 176 above the floor 18 and beneath the table 16, into which the column stand 20 continuing downwards beyond the table 16 extends with the guide rail 22 so that in this housing 176 the folding carriage 24 can be positioned in a starting position without a recess 26 needing to be provided in the floor 18.

In this embodiment, the inventive folding machine, comprising the machine frame 10 and the underframe 170 with the housing 176, can thus be set up anywhere without the provision of a recess.

The inventive folding machines are, however, not only suitable, as described in conjunction with the first embodiment, for joining together sheet-metal parts 80 and 82 designed as sheet-metal plates. The sheet-metal parts 80 and 82 can, in principle, have the most varied of shapes. It is merely necessary for the shape to be such that the sheet-metal parts 80 and 82 can be fixed in position, on the one hand, with the clamping devices 60 and 96 or 60 and 98, respectively, and thereby abut with their vertical borders 132 and 150, respectively, on the stop surfaces 128 and 148, respectively, in order to obtain an exact positioning of the vertical edges 114 and 116, respectively, for the folding procedure.

The inventive folding machines are also suitable, in particular, for the production of sheet-metal channels in accordance with the most varied of production processes.

Figure 9:
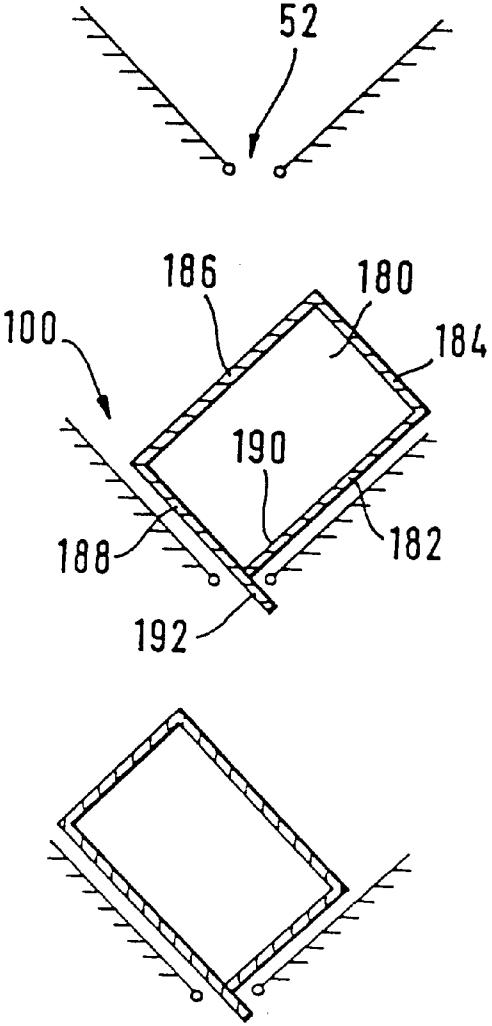

As illustrated in FIG. 9, it is, for example, possible with the inventive folding machine to manufacture a sheet-metal channel already bent into a rectangle from a sheet-metal plate and having altogether four side walls 182, 184, 186 and 188 by joining the free edges 190 and 192 of the side walls 182 and 188 with one another by means of a folded seam connection so that the side walls 182 and 188 correspond to the sheet-metal parts designated as 80 and 82 in conjunction with the detailed description of the folding machine.

In this respect, the sheet-metal channel already bent from a sheet-metal plate is located on the table surface 100 of the table 16 and can thus be moved on the table surface 100 in the simplest of ways, for example by a single person, in order to clamp the side walls 182 and 188 by means of the clamping devices 60, 96 and 98 for carrying out the folding procedure.

In the same way, the finished, folded channel can be handled in the simplest of ways by displacing it on the table surface 100.

Figure 10:
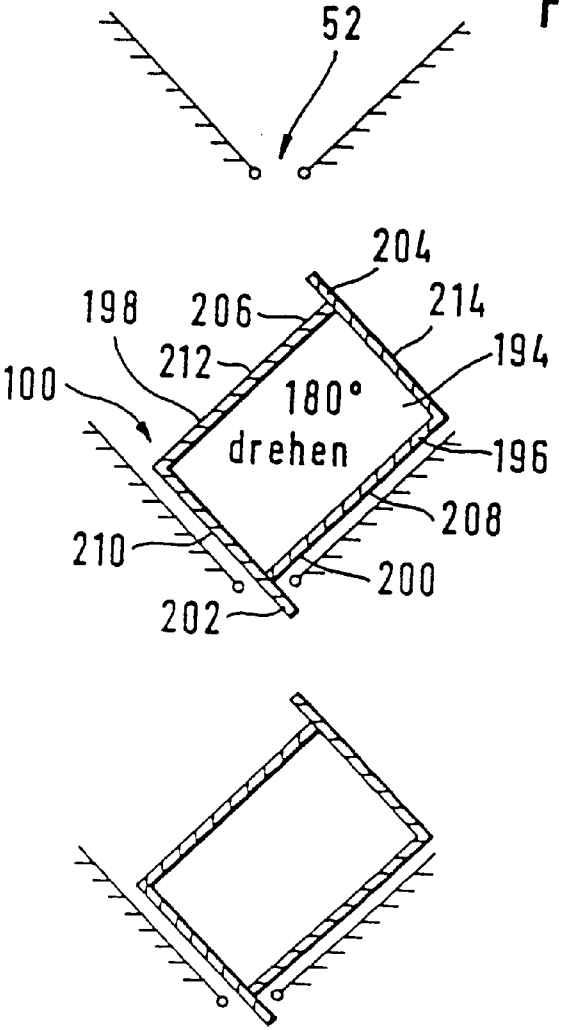
FIG. 9 shows a schematic illustration of a first special process for the production of a sheet-metal channel with an inventive folding machine in the plan view and FIG. 10 shows a schematic illustration of a second special process for the production of a sheetmetal channel with an inventive folding machine similar to FIG. 9.

Alternatively thereto, it is possible to produce a sheet-metal channel 194 by joining with one another two sheet-metal parts 196, 198 which are bent at right angles in relation to one another by means of a folded seam connection in the region of their respective edges 200 and 202 or 204 and 206 (FIG. 10).

On account of the fact that the respective, angled sheet-metal parts 196, 198 have a sufficient inherent rigidity and stability as a result of their angle, the angled sheet-metal parts 196 and 198 can be handled and placed on the table surface 100 and moved particularly easily in order to be able to position the angled sheet-metal parts 196 and 198 in the manner described and to clamp them by means of the clamping devices 60, 96 and 98, wherein the respective sides 208 and 210 or 212 and 214 are positioned and clamped like the sheet-metal parts 80 and 82 in accordance with the preceding description.

We claim:

1. A folding machine for joining the edges of two sheet-metal parts by means of a folding procedure, said sheet-metal parts forming an angle therebetween, comprising:

a machine frame;

a guide fixed to said machine frame and extending in an essentially vertical guide direction;

a folding carriage movable with respect to said guide in said guide direction by a drive, said folding carriage having at least one pair of folding rollers for folding edges of the sheet-metal parts in an essentially vertical folding direction essentially parallel to said guide direction;

holding devices arranged on the machine frame for fixing the sheet-metal parts in position during the folding procedure; and support surfaces fixed to said machine frame and extending in a supporting plane at right angles to the essentially vertical guide direction, said support surfaces supporting the sheet-metal parts via edges of the sheet-metal parts extending transversely to the edges resulting in the fold whereby the sheet metal parts are held and folded in an essentially vertical direction.

2. A folding machine as defined in claim 1, wherein the sheet-metal parts are adapted to be prealigned by the support surfaces for fixing in position by means of the holding devices.

3. A folding machine as defined in claim 1, wherein the sheet-metal parts are adapted to be positioned exactly by the support surfaces relative to the machine frame for fixing in position by means of the holding devices.

4. A folding machine as defined in claim 1, wherein the support surfaces are part of a table surface extending at right angles to the folding direction.

5. A folding machine as defined in claim 1, wherein the guide means extends beyond at least one length of the folding carriage on a side of the supporting plane located opposite the holding devices.

6. A folding machine as defined in claim 1, wherein the folding carriage is adapted to be positioned in a starting position for the folding procedure on a side of the supporting plane located opposite the holding devices.

7. A folding machine as defined in claim 1, wherein each holding device has a contact surface, the respective sheet-metal part being adapted to abut on said surface.

8. A folding machine as defined in claim 7, wherein each holding device comprises a clamping device providing a first clamping surface as said contact surface.

9. A folding machine as defined in claim 8, wherein each clamping device has at least one clamping element with a second clamping surface movable relative to the first clamping surface for clamping the sheet-metal parts.

10. A folding machine as defined in claim 8, wherein each clamping device clamps an edge region of the respective sheet-metal part extending transversely to the folding direction.

11. A folding machine as defined in claim 1, wherein each sheet-metal part is adapted to be fixed in position by means of a holding device at both edge regions located opposite one another in said folding direction.

12. A folding machine as defined in claim 1, wherein one holding device is arranged such that it is in a position to clamp an edge region of the sheet-metal parts level with the supporting plane.

13. A folding machine as defined in claim 12, wherein the holding device arranged at the level of the supporting plane is arranged to be stationary on the machine frame.

14. A folding machine as defined in claim 1, wherein a holding device arranged at a distance from the supporting plane is provided for each sheet-metal part.

15. A folding machine as defined in claim 14, wherein the holding device arranged at a distance from the supporting plane is displaceable in said folding direction.

16. A folding machine as defined in claim 15, wherein a guide means extending essentially in a vertical direction is provided on the machine frame for the holding device.

17. A folding machine as defined in claim 16, wherein the holding device is adapted to be secured in position in the respective guide means at predeterminable distances from the supporting plane.

18. A folding machine as defined in claim 1, wherein pivotable stops are provided on the machine frame for a positioning of the edges of the sheet-metal parts resulting in the fold.

19. A folding machine as defined in claim 18, wherein a common stop is provided for the edges of the two sheet-metal parts resulting in the fold.

20. A folding machine as defined in claim 18, wherein the stops are provided with edge sensors for each sheet-metal part.

21. A folding machine as defined in claim 20, wherein the edge sensor is connected to a control for activating at least one holding device for the respective sheet-metal part when the edge sensor is triggered.

22. A folding machine as defined in claim 21, wherein the control for the respective sheet-metal part activates the holding device arranged at a distance above the support surfaces.

23. A folding machine as defined in claim 22, wherein the control activates the holding device arranged at the level of the supporting plane for the respective sheet-metal part.

24. A process for joining sheet-metal parts by means of a folded seam connection integrally formed at edge regions of the sheet-metal parts, wherein the sheet-metal parts are inserted into and fixed in position in a folding machine for formation of the folded seam connection by a folding carriage moving in a folding direction along said edge regions, comprising the steps of:

inserting the sheet-metal parts into the folding machine and fixing them in position with an essentially vertical alignment of the edge regions to be folded; and moving the folding carriage in an essentially vertical direction to join the sheet-metal parts by folding at said edge regions; whereby the sheet metal parts are held and folded in an essentially vertical direction.

25. A process as defined in claim 24, wherein the sheet-metal parts are supported on support surfaces prior to and/or during said insertion step, said surfaces being located in a supporting plane extending at right angles to the folding direction.

26. A process as defined in claim 24, wherein the sheet-metal parts are placed on a table surface extending in the supporting plane prior to or after production of the folded seam connection.

27. A process as defined in claim 24, wherein said sheet-metal parts are already angled at least once.

* * * * *